US006534918B1

(12) United States Patent
Peterek et al.

(10) Patent No.: US 6,534,918 B1
(45) Date of Patent: Mar. 18, 2003

(54) HIGH PRESSURE DISCHARGE LAMP WITH TUNGSTEN ELECTRODE RODS HAVING SECOND PARTS WITH ENVELOPE OF RHENIUM

(75) Inventors: Manfred Peterek, Aachen (DE); Joseph F. R. Eijsermans, Eindhoven (NL); Dorothea Seebode, Aachen (DE); Marcus Kubon, Aachen (DE); Angela Jörres, Julich (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/338,052

(22) Filed: Jun. 22, 1999

(30) Foreign Application Priority Data

Jun. 30, 1998 (EP) ..... 98202198

(51) Int. Cl.[7] ..... H01J 17/04; H01J 61/04

(52) U.S. Cl. ..... 313/631; 313/633; 313/634; 313/332

(58) Field of Search ..... 313/631, 633, 313/634, 318.01, 331, 332

(56) References Cited

U.S. PATENT DOCUMENTS 3,716,743 A * 2/1973 Mizuno et al. ..... 313/625
4,413,205 A * 11/1983 Ooms ..... 313/579
5,004,951 A * 4/1991 Honda et al. ..... 313/631
5,461,277 A * 10/1995 Van Gennip et al. ..... 313/331
5,510,675 A * 4/1996 Bunk et al. ..... 313/631
5,568,008 A * 10/1996 Narita ..... 313/113
5,585,694 A * 12/1996 Goldburt et al. ..... 313/491
6,060,829 A * 5/2000 Kubon et al. ..... 313/631
6,169,365 B1 * 1/2001 Kubon et al. ..... 313/631

FOREIGN PATENT DOCUMENTS

| | | | |
|---|---|---|---|
| DE | 3536553 | 10/1985 | ..... H01J/61/04 |
| EP | 609477 | 2/1993 | ..... H01J/61/36 |
| EP | 581354 | 7/1993 | ..... H01J/61/36 |

* cited by examiner

*Primary Examiner*—Vip Patel
*Assistant Examiner*—Kevin Quarterman
(74) *Attorney, Agent, or Firm*—Frank J. Keegan; Dicran Halajian

(57) ABSTRACT

The high-pressure discharge lamp comprises a sealed lamp vessel (1) having a quartz glass wall (2) enclosing a discharge space (3). Metal foils (4) are embedded in the wall, connected to electrode rods (6) projecting from the wall into the discharge space. The electrode rods (6) have a first part (7*a*) and a second part (7*b*) with a diameter of between 250 and 350 $\mu$m and at least an envelope (7*c*) made of rhenium. The second part, which is positioned within the wall (2), prevents premature failure of the lamp caused by leakage.

22 Claims, 1 Drawing Sheet

HIGH PRESSURE DISCHARGE LAMP WITH TUNGSTEN ELECTRODE RODS HAVING SECOND PARTS WITH ENVELOPE OF RHENIUM

BACKGROUND OF THE INVENTION

The invention relates to a high-pressure gas discharge lamp comprising:

a lamp vessel which is closed in a vacuumtight manner and has a quartz glass wall enclosing a discharge space;

metal foils embedded in the wall of the lamp vessel and each connected to a respective external current conductor;

tungsten electrode rods each connected to a respective one of said metal foils and projecting from the wall of the lamp vessel into the discharge space;

an ionizable filling in the discharge space;

the lamp being defined by the following relation $$f_{inw} >= 40\%$$

in which:

$f_{inw}$=fraction of length of the electrode rod enclosed in the wall of the lamp vessel.

A high-pressure gas discharge lamp of this type is known from U.S. Pat. No. 5,461,277. The known lamp is suitable for use as a vehicle headlamp and has electrode rods of a thickness of 250 $\mu$m which may or may not have an envelope at their ends and may be made of, for example, thoriated tungsten.

Stringent requirements are imposed on the speed with which the lamp, after it has been ignited, provides a large fraction of the luminous flux during stable operation. It is also necessary that the lamp can be ignited while it is still hot due to a previous operating period. The lamp is ignited at a voltage of several kV and a frequency of several kHz in order to comply with these requirements.

In the manufacture of the known lamp, a seal is made in which one or several of said metal foils are enclosed in the wall. During this operation, the quartz glass is softened at the area where this seal is to be created in the presence of the metal foil, the external current conductor and the electrode rod. Subsequently, the lamp, or the lamp-to-be, cools down. Due to its relatively high coefficient of linear thermal expansion (approximately $45*10^{-7}$ $K^{-1}$), the electrode rod then contracts more strongly than the quartz glass in which it is embedded. Quartz glass is a glass having an $SiO_2$ content of at least 98% by weight, the coefficient of expansion of the glass is approximately $6*10^{-7}$ $K^{-1}$. For a good adhesion between the rod and the quartz glass, obtained by an additive to the electrode rod tungsten, such as thorium oxide, a coating of quartz glass around the rod is obtained, which is mechanically unconnected with the quartz glass of the wall. If the electrode rod and the quartz glass adhere insufficiently to each other, a capillary space is created due to shrinkage around this rod. No such capillary space is created around the metal foil, often a molybdenum foil, because of the foil shape.

In the known lamp, there is often a good adhesion between the rod and the quartz glass and thus there is a coating of quartz glass around the rod. The quartz glass coating of the electrode rods in the known lamp enhances their thermal capacity (the energy which is necessary for the same rise of temperature) and also increases their thermal conductance (the quantity of heat which can be depleted per unit of time). On the other hand, their electrical conductivity is not affected. The higher thermal capacity retards the rise of temperature of the rods during ignition of the lamp, so that the permanent contact with the embedded metal foil enables the surrounding quartz glass of the wall to assume a higher temperature and to expand, also because of the heat developed in this foil due to the passage of current.

It has been found that the coatings of species of one type of lamp may have alternating lengths. This may be due to small variations of temperature of the quartz glass when the seal is being made. It is a drawback that the absence of a coating or an insufficient coating results in rejects during the lamp production and that the known lamp has only a short lifetime when there is no or not enough quartz glass coating and when this lamp is often switched on and switched off after a short operating period.

When such a lamp without coating is ignited, the temperature of the electrode rods rises steeply owing to the high current flowing through them and owing to heat transfer from the discharge. The quartz glass does not instantaneously follow this temperature rise. Owing to their higher temperature and their higher coefficient of expansion, the rods will come into contact with the quartz glass and exert pressure on it. It was found that damage, such as microcracks, then occurred in the quartz glass, which microcracks generally increase in number and size during subsequent ignition periods. This leads to a (premature) end of the lifetime of the lamp owing to leakage, causing constituents of the filling to escape so that the lamp no longer ignites, or the lamp vessel is broken.

Lamps complying with the relation $f_{inw}$>=40% have a greater risk of occurrence of the above-mentioned detrimental phenomena, unless special circumstances are created, for example, a quartz glass coating around the electrode rod.

Another drawback is that the coating leads to unwanted and troublesome reflections of the light generated in the discharge.

U.S. Pat. No. 5,510,675-A discloses electrodes, a part of which is made of rhenium and has a thickness of 400 $\mu$m. However, the part made of rhenium does project very far into the discharge space and is only provided with a head at its very last end, with a thickness of, for example 1 mm or an enveloping winding of tungsten. However, this large head leads to the unfavorable effect of lamp flickering, i.e. the point of contact of the discharge arc displaces suddenly over the head.

SUMMARY OF THE INVENTION

It is an object of the invention to provide a high-pressure gas discharge lamp, having a simple construction and counteracting said drawbacks.

According to the invention, the electrode rods have first parts projecting into the discharge space, which first parts are at least substantially made of tungsten, and second parts enclosed at least partly in the wall, which second parts have a thickness ranging between 250 $\mu$m and 350 $\mu$m and at least an envelope of rhenium, said first and second parts contacting and being connected to each other via facing ends.

Since the electrodes are composed of a first and a second part, it is possible to adapt the electrodes to circumstances. The first part is made in conformity with the end of the electrode of the known lamp projecting into the discharge space, so that it can withstand the heat developed by the high starting currents and the discharge during the lifetime of the lamp. The first part of the electrode is made of tungsten so that a strong evaporation of electrode material is prevented, as will occur if the first part consists of rhenium. The second part is designed in such a way that the problem of leakage or breakage of the lamp due to expansion and, consequently, exertion of pressure on the quartz glass by the electrode rod upon (re)ignition of the lamp at least substantially does not occur anymore. The first and the second part of the electrode may be secured to each other in accordance with conventional techniques such as laser welding.

In second parts having a relatively thick envelope of rhenium or being entirely made of rhenium, a greater thickness is necessary than when this second part is made of, for example, tungsten having a relatively thin envelope of rhenium due to the smaller coefficient of thermal conductance of rhenium compared with tungsten, $S_{Re}$~$0.3*S_W$. Experiments have proved that a thickness of minimally 250 μm is necessary for second parts substantially made of rhenium so as to ensure a sufficient depletion of heat.

It has been found that in lamps complying with the relation $f_{inw}$>=40%, the occurring problems of leakage at least substantially do not occur at relatively small thicknesses of second parts of the electrode rods enclosed in the wall. The risk of leakage or breakage of the lamp is considerably reduced if the thickness of these second parts is chosen to be smaller than 350 μm. The successful use of relatively large thicknesses in second parts having at least an envelope of rhenium is based on the ductility of rhenium. When exerting pressure on the quartz glass due to expansion by the electrodes, this pressure will be more evenly distributed due to deformation of the relatively ductile rhenium than when using electrodes which are made of, for example, the much less ductile tungsten. If electrodes having at least an envelope of rhenium are used, fewer concentrations of tensions will thus occur in the quartz glass so that the use of larger thicknesses than in similar tungsten electrodes is possible.

An important advantage of the measure according to the invention is that it provides the possibility of using electrode rod material which is free from thorium without detrimentally influencing the lifetime of the lamp.

The capillary spaces which have formed during embedding of the electrode rod in the quartz glass are relatively small in second parts having thicknesses of less than 350 μm. Therefore, no large quantities of salts can accumulate in these capillary spaces, which salts would otherwise have been extracted from the discharge. In the relatively small capillary spaces, the second part of the electrode rod locally makes permanent contact with the wall of the lamp vessel so that a satisfactory depletion of heat is obtained.

Due to the relatively small thermal conductance in second parts which are largely or entirely made of rhenium, it is also favorable that the first parts proximate to their transition to the second parts are in permanent contact with the wall of the lamp vessel, for example, partly enclosed in the wall, for example, over a length of 0.1–1.0 mm. The depletion of heat of the composite electrode is thereby even further enhanced.

Due to the high starting currents upon ignition of the lamp and the heat developed as a result of the discharge, not only relatively high temperatures occur in the second parts but also in the first parts of the electrodes. In first parts having a thickness of less than 250 μm, there is a relatively great risk of melting. Electrodes having first parts with a thickness of more than 250 μm have a sufficient thermal conductance so that the risk of melting is reduced quite considerably. Moreover, the first parts preferably have a thickness of less than 400 μm. Then there is hardly any risk that the unfavorable effect of lamp flickering will occur.

The lengths of the first and second parts are also determined by the total length of the entire electrode. In a favorable embodiment the entire electrode has a length of 4.5 to 7.5 mm, preferably 6 mm. The choice of the length of the separate parts is such that the connection of the first part to the second part is at least substantially located at the boundary surface of the wall and the discharge space, at the location where the electrode projects into the discharge space.

The high-pressure gas discharge lamp according to the invention may be used, for example, as a vehicle headlamp or in an optical system of a different kind. To this end, the lamp may be provided with a lamp cap and may or may not be surrounded by an outer envelope. A lamp cap may or may not be integrated with a reflector.

The metal foils may be embedded next to one another in one region of the wall, or in regions situated at a distance from one another, for example, opposite one another. The first parts of the electrode rods may or may not have an enveloping winding at their ends in the discharge space. The first parts of the electrode rods may be made of undoped tungsten, for example tungsten-ZG, or of doped tungsten such as W with 1.5% by weight of Th.

When doped tungsten is used, a small content of crystal growth-regulating means such as 0.01% by weight in total of K, Al and Si may be added so as to influence the tungsten grain size. The second parts may be made of undoped rhenium or of doped rhenium, for example, doped with Mo and/or W, normally with a doping concentration of less than 10% by weight in total.

The ionizable filling may comprise, inter alia, a rare gas, mercury and a mixture of metal halides, for example, rare-earth halides which are the halides of the lanthanides, scandium and yttrium.

These and other aspects of the invention are apparent from and will be elucidated, by way of non-limitative example, with reference to the embodiments described hereinafter.

DETAILED DESCRIPTION OF THE PREFERRED EMBODIMENTS

Figure 1:
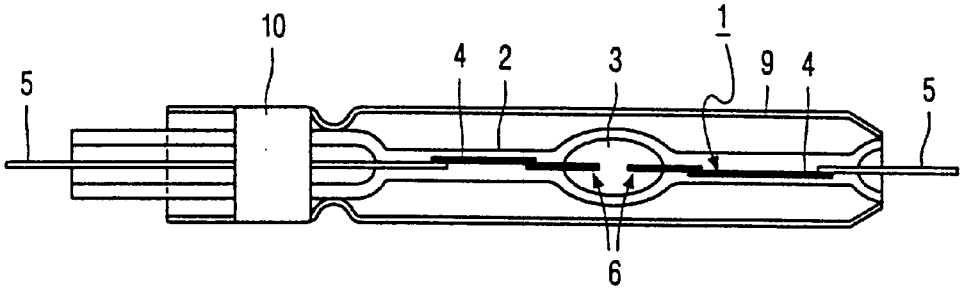
FIG. 1 shows a lamp in a side elevation.

In FIG. 1, the high-pressure gas discharge lamp has a lamp vessel 1 which is closed in a vacuumtight manner and a quartz glass wall 2 enclosing a discharge space 3. Metal foils 4, Mo with 0.5% by weight of $Y_2O_3$ in the Figure, each connected to respective external current conductors 5, of Mo in this embodiment, are embedded in the wall of the lamp vessel. Tungsten electrode rods 6 each connected to a respective one of said metal foils 4 project from the wall of the lamp vessel into the discharge space. An ionizable filling is present in the discharge space 3.

Connected to the metal foils 4 with the external conductors 5 secured thereto, the electrode rods 6 are partly enclosed in the wall of the lamp vessel, and the wall is fused with the conductors at the area of these conductors, or the wall has been flattened so as to realize a pinched seal.

In the Figure, the lamp vessel is surrounded by an outer envelope 9 and coupled thereto. The lamp may be gripped by a lamp cap at a metal clamping sleeve 10.

The lamp described has a filling of mercury, sodium iodide and scandium iodide, and xenon, for example, xenon at a pressure of 7 bar at room temperature, and consumes a power of 35 W during operation at rated voltage.

Figure 2:
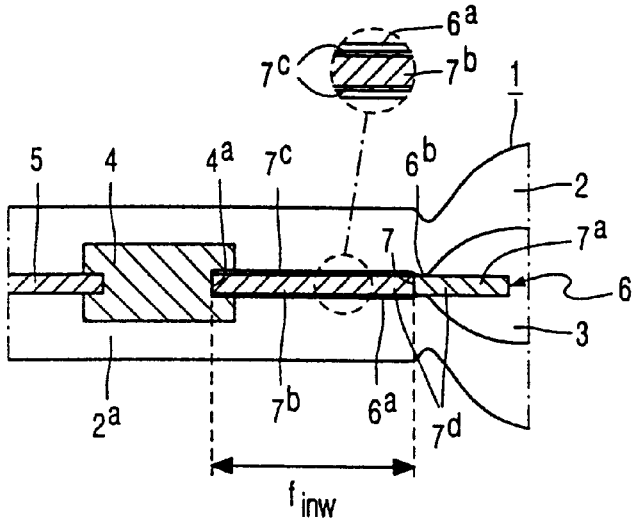
FIG. 2 shows a detail of FIG. 1 on an enlarged scale.

FIG. 2 shows that the electrode rods 6 are enclosed in the wall 2 of the lamp vessel 1 over a fraction of length $f_{inw}$ of approximately 75%, so that the lamp complies with the relation $f_{inw}$>=40%. The electrode rods 6 each having a length of approximately 6 mm each have a first part 7*a* and a second part 7*b* with a length of approximately 1.5 mm and approximately 4.5 mm, respectively, which are adjacent via the ends 7*d* of the first and the second part and are connected to each other at an interface 7. The interface 7 is located near the wall 2 of the lamp vessel 1. The first part 7*a* is in permanent contact with the wall 2 of the lamp vessel 1 at contact area 6*b,* however, without a risk of leakage or breakage of the lamp. The electrode rods 6 each have the second part 7*b* with an envelope 7*c* in the wall 2, at least proximate to the relevant metal foil 4, which second part is mechanically unconnected with the glass of the wall.

In the embodiment shown in FIG. 2, the first part 7*a* of the electrode rod 6 has a thickness of 300 μm and is made of tungsten, and the second part 7*b* of the electrode rod 6 has a thickness of 300 μm and is made of rhenium. The Figure shows that the second part 7*b* and the capillary 6*a* around it terminate at the weld 4*a* of the rod on the foil. The seal 2*a* is vacuumtight in an area between the external current conductor 5 and the electrode rod 6.

Figure 3:
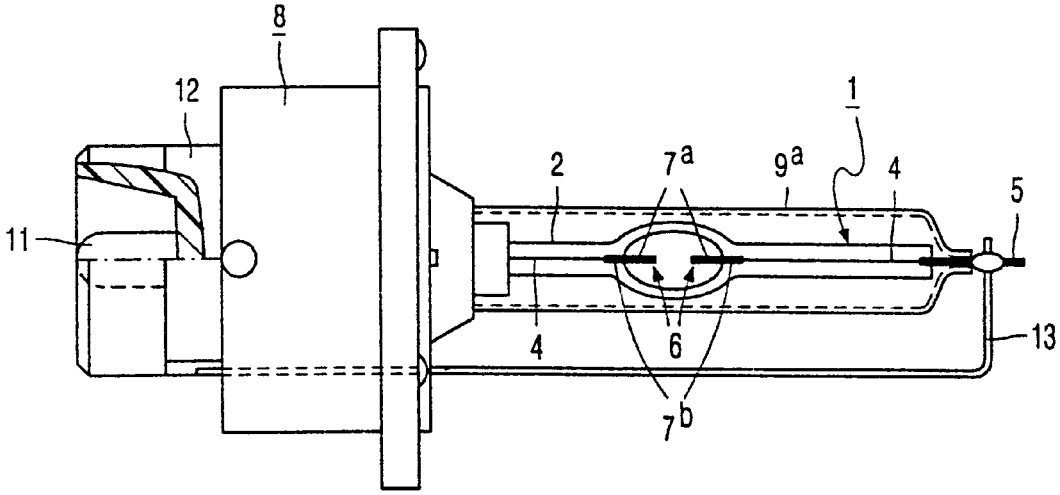
FIG. 3 shows the lamp of FIG. 1 with a lamp cap in a side elevation.

In FIG. 3, the lamp vessel 1 is enclosed in a different outer envelope 9*a* and coupled thereto. The lamp vessel is fixed in a lamp cap 8 of the bayonet type, provided with a central pin contact 11 and a ring contact 12 which are connected to respective electrode rods 6, the ring contact via a connection conductor 13. The lamp vessel 1 provided with such a lamp cap 8 is eminently suitable as a vehicle headlamp.

What is claimed is:

1. A high-pressure gas discharge lamp comprising:

a lamp vessel which is closed in vacuumtight manner and has a quartz glass wall enclosing a discharge space;

metal foils embedded in the wall of the lamp vessel, each connected to a respective external current conductor;

electrode rods each connected to a respective one of said metal foils and projecting from the wall of the lamp vessel into the discharge space;

an ionizable filling in the discharge space;

the lamp being defined by the following relation, $$f_{inw}>=40\%$$

in which:

$f_{inw}$=fraction of length of the electrode rod enclosed in the wall of the lamp vessel, wherein the electrode rods have first and second discrete parts electrically connected together at facing ends, said first parts projecting into the discharge space and are a first material, said first material consisting essentially of tungsten, said second parts are enclosed in the wall and are a second material, said second material being different from the first material and comprising rhenium, each of said electrode rods changing at said facing ends from the first material to the second material.

2. A high-pressure gas discharge lamp as claimed in claim 1, wherein the first parts of the electrode rods are in permanent contact with the wall of the lamp vessel at a contact area.

3. A high-pressure gas discharge lamp as claimed in claim 1 wherein the first parts of the electrode rods have a thickness of 250 μm to 400 μm.

4. A high-pressure gas discharge lamp as claimed in claim 1 wherein the electrode rods have a length of between 4.5 mm and 7.5 mm.

5. A high-pressure gas discharge lamp as claimed in claim 1 further comprising a lamp cap.

6. A high-pressure gas discharge lamp as claimed in claim 1 wherein the second parts of said electrode rods have a thickness ranging between 250 μm and 350 μm.

7. A high-pressure gas discharge lamp as claimed in claim 1 wherein the second parts of said electrode rods are at least enveloped in rhenium.

8. A high-pressure gas discharge lamp as claimed in claim 1 wherein the first part of the electrode is secured to the second part of the electrode by laser welding.

9. A high-pressure gas discharge lamp as claimed in claim 1 wherein the electrode rods do not contain thorium.

10. A high-pressure gas discharge lamp comprising:

a lamp vessel which is closed in vacuumtight manner and has a wall enclosing a discharge space;

metal foils embedded in the wall of the lamp vessel, each connected to a respective external current conductor;

electrode rods each connected to a respective one of said metal foils and projecting from the wall of the lamp vessel into the discharge space;

an ionizable filling in the discharge space;

wherein the electrode rods have first and second discrete parts electrically connected together at facing ends, said first parts projecting into the discharge space, said first parts consist essentially of tungsten and are not substantially made of rhenium, said second parts are enclosed in the wall, which second parts are comprised of rhenium.

11. A high-pressure gas discharge lamp as claimed in claim 10, wherein, $$f_{inw}>=40\%$$

in which:

$f_{inw}$=fraction of length of the electrode rod enclosed in the wall of the lamp vessel.

12. A high-pressure gas discharge lamp as claimed in claim 10, wherein the first parts of the electrode rods are in permanent contact with the wall of the lamp vessel at a contact area.

13. A high-pressure gas discharge lamp as claimed in claim 10 wherein the first parts of the electrode rods have a thickness of 250 μm to 400 μm.

14. A high-pressure gas discharge lamp as claimed in claim 10 wherein the electrode rods have a length of between 4.5 mm and 7.5 mm.

15. A high-pressure gas discharge lamp as claimed in claim 10 further comprising a lamp cap.

16. A high-pressure gas discharge lamp as claimed in claim 10 wherein the second parts of said electrode rods have a thickness ranging between 250 μm and 350 μm.

17. A high-pressure gas discharge lamp as claimed in claim 10 wherein the second parts of said electrode rods are at least enveloped in rhenium.

18. A high-pressure gas discharge lamp as claimed in claim 10 wherein the first part of the electrode is secured to the second part of the electrode by laser welding.

19. A high-pressure gas discharge lamp as claimed in claim 10 wherein the electrode rods do not contain thorium.

20. A high-pressure gas discharge lamp comprising:

a lamp vessel which is closed in vacuumtight manner and has a wall enclosing a discharge space;

metal foils embedded in the wall of the lamp vessel, each connected to a respective external current conductor;

electrode rods each connected to a respective one of said metal foils and projecting from the wall of the lamp vessel into the discharge space;

an ionizable filling in the discharge space;

wherein the electrode rods have first and second discrete parts electrically connected together at facing ends, said first parts projecting into the discharge space, said first parts are a first material consisting essentially of tungsten, said second parts are enclosed in the wall, which second parts are a second material comprised of rhenium, said first and second parts being of different thickness, and each of said electrode rods changing at said facing ends from the first material to the second material.

21. A high-pressure gas discharge lamp comprising:

a lamp vessel which is closed in vacuumtight manner and has a wall enclosing a discharge space;

metal foils embedded in the wall of the lamp vessel, each connected to a respective external current conductor;

electrode rods each connected to a respective one of said metal foils and projecting from the wall of the lamp vessel into the discharge space;

an ionizable filling in the discharge space;

the electrode rods having first and second discrete parts electrically connected together at facing ends, said first parts projecting into the discharge space, which first parts consist essentially of tungsten, said second parts are enclosed in the wall, which second parts consist of rhenium.

22. A high-pressure gas discharge lamp comprising:

a lamp vessel which is closed in vacuumtight manner and has a quartz glass wall enclosing a discharge space;

metal foils embedded in the wall of the lamp vessel, each connected to a respective external current conductor;

electrode rods each connected to a respective one of said metal foils and projecting from the wall of the lamp vessel into the discharge space;

an ionizable filling in the discharge space;

the electrode rods having first and second discrete parts electrically connected together at facing ends, said first parts projecting into the discharge space, which first parts are a first material, said first material consisting essentially of tungsten, said second parts are enclosed in the wall, which second parts are a second material, said second material having a greater thickness, a smaller coefficient of thermal conductance and greater ductility than the first material, each of said electrode rods changing at said facing ends from the first material to the second material.

* * * * *